US007802337B2

(12) United States Patent
van Roosmalen et al.

(10) Patent No.: US 7,802,337 B2
(45) Date of Patent: Sep. 28, 2010

(54) RETRACTABLE RAMP

(75) Inventors: Linda van Roosmalen, Verona, PA (US); Francis S. Glogowski, Cranberry Township, PA (US); David A. Heiner, Pittsburgh, PA (US); Robert S. Jamison, III, Pittsburgh, PA (US); Peter D. Horvath, Brownsville, PA (US); Steven Walker, Peters Township, PA (US)

(73) Assignee: Marshall Elevator Company, Pittsburgh, PA (US)

( * ) Notice: Subject to any disclaimer, the term of this patent is extended or adjusted under 35 U.S.C. 154(b) by 396 days.

(21) Appl. No.: 11/928,481

(22) Filed: Oct. 30, 2007

(65) Prior Publication Data

US 2009/0106918 A1 Apr. 30, 2009

(51) Int. Cl.
*E01D 19/00* (2006.01)

(52) U.S. Cl. ..... 14/69.5; 14/71.1; 105/425; 414/537

(58) Field of Classification Search ..... 14/69.5, 14/71.1, 72.5; 414/537; 280/166, 769, 762; 104/30, 31; 105/425, 426, 432–433, 436
See application file for complete search history.

(56) References Cited

U.S. PATENT DOCUMENTS 782,165 A 2/1905 McElvain
797,861 A 8/1905 Melgarejo
1,149,759 A 8/1915 Hedley et al.
1,346,891 A 7/1920 Huwyler
2,190,708 A * 2/1940 Fowler ..... 105/238.1
(Continued)

FOREIGN PATENT DOCUMENTS

JP 09020235 1/1997
(Continued)

*Primary Examiner*—Raymond W Addie
(74) *Attorney, Agent, or Firm*—The Webb Law Firm

(57) ABSTRACT

A ramp assembly includes an elongated frame sized and shaped to extend between a first door and a second door aligned opposite each other on opposed sides of a vehicle; a first sectional ramp section having a first end and a second end; and a second sectional ramp having a first end and a second end. The first sectional ramp is slidably moveable along the frame from a stored position to a deployed position on either of the opposed sides of the vehicle. The second sectional ramp is positioned adjacent the first sectional ramp and is slidably moveable along the frame from a stored position to a deployed position on either of the opposed sides of the vehicle. The ramp assembly also includes a first locking mechanism coupled to the first end of each of the first sectional ramp and the second sectional ramp; and a second locking mechanism coupled to the second end of each of the first sectional ramp and the second sectional ramp. The first locking mechanism is placed in a locked position and the second locking mechanism is placed in an unlocked position to allow the first and second sectional ramps to be coupled together and moved from the stored position to the deployed position through the first door. The second locking mechanism is placed in a locked position and the first locking mechanism is placed in an unlocked position to allow the first and second sectional ramps to be coupled together and moved from the stored position to the deployed position through the second door.

20 Claims, 12 Drawing Sheets

U.S. PATENT DOCUMENTS 3,288,522 A 11/1966 Norton
3,730,361 A 5/1973 Haynes
3,933,258 A 1/1976 Forsyth et al.
4,499,970 A 2/1985 Hussey
4,528,711 A 7/1985 Packer
4,536,004 A 8/1985 Brynielsson et al.
4,559,659 A 12/1985 Hunter, Jr.
4,726,516 A 2/1988 Cree
4,827,548 A 5/1989 Hood
4,845,792 A 7/1989 Bakula et al.
4,900,217 A 2/1990 Nelson
5,070,794 A 12/1991 Kunst et al.
5,090,335 A * 2/1992 Russell ..... 108/44
5,133,634 A 7/1992 Gingrich et al.
5,137,114 A 8/1992 Yde et al.
5,160,236 A * 11/1992 Redding et al. ..... 414/537
5,357,869 A 10/1994 Barjolle et al.
5,357,962 A * 10/1994 Green ..... 600/443
5,380,144 A * 1/1995 Smith et al. ..... 414/537
5,517,708 A 5/1996 Baranowski
5,636,399 A 6/1997 Tremblay et al.
5,676,515 A 10/1997 Haustein
5,775,232 A 7/1998 Golemis et al.
5,803,523 A 9/1998 Clark et al.
5,829,945 A 11/1998 Stanley
5,832,555 A 11/1998 Saucier et al.
6,010,298 A 1/2000 Cohn et al.
6,119,634 A * 9/2000 Myrick ..... 119/847
6,167,816 B1 1/2001 Lavery et al.
6,186,733 B1 2/2001 Lewis et al.
6,203,265 B1 3/2001 Cohn et al.
6,210,098 B1 4/2001 Cohn et al.
6,238,168 B1 5/2001 Cohn et al.
6,343,908 B1 2/2002 Oudsten et al.
6,345,950 B1 * 2/2002 Gerwitz ..... 414/537
6,409,458 B1 6/2002 Cohn et al.
6,443,683 B2 9/2002 Randak
6,470,523 B1 10/2002 Sardonico
6,481,037 B1 11/2002 Fullerton et al.
6,484,344 B1 11/2002 Cooper
6,503,036 B1 1/2003 Bequette et al.
6,536,064 B1 * 3/2003 Swink et al. ..... 14/69.5
6,599,080 B1 7/2003 Karlsson
6,599,090 B2 * 7/2003 Ozaki et al. ..... 415/206
6,802,095 B1 10/2004 Whitmarsh et al.
6,834,903 B2 12/2004 Harper et al.
6,860,701 B2 3/2005 Kiser
6,880,194 B2 * 4/2005 O'Donnell et al. ..... 14/69.5
7,052,227 B2 5/2006 Navarro
7,082,637 B1 * 8/2006 Griffin ..... 14/69.5
7,137,162 B2 * 11/2006 Spencer et al. ..... 14/71.5
7,246,844 B2 * 7/2007 Guidry ..... 296/173
7,721,369 B2 * 5/2010 Hao et al. ..... 14/71.1
2003/0056686 A1 3/2003 Morlok
2006/0245883 A1 11/2006 Fontaine et al.
2009/0255437 A1 * 10/2009 Hachet et al. ..... 105/344

FOREIGN PATENT DOCUMENTS

JP 2003073081 3/2003

* cited by examiner

RETRACTABLE RAMP

STATEMENT REGARDING FEDERALLY SPONSORED RESEARCH

This invention was made with government support under Department of Education PR/Award No. H133S050136 awarded by the Department of Education. The government has certain rights in this invention.

BACKGROUND OF THE INVENTION

1. Field of the Invention

The disclosure contained in this document relates to a retractable step or ramp that is automatically or manually extensible from the floor of a railcar or other means of transportation for the boarding and exit of passengers, and particularly to a retractable step portion or ramp portion that is selectively extensible outwardly from either side of the railcar or other vehicle to enable boarding and exit of passengers through either door on opposed sides of the railcar or other vehicle.

2. Description of Related Art

There is a need for ambulatory people and those unable to climb up steps to be able to gain access to public transportation systems for employment, education, recreation and other purposes. Commuter rail systems, in particular, have difficulty providing suitable access to all passengers, including the elderly and passengers with mobility limitations due to variable horizontal and vertical gaps between the railcars and passenger boarding platforms. There are several reasons for the variability in horizontal and vertical gap. Many commuter rail systems share rail platforms with freight trains, and freight car bodies are generally wider than the bodies of passenger railcars, resulting in a horizontal gap between passenger railcars and high-level platforms. Also, many train stations are built along a curved track, which causes variation in a horizontal gap between the platform and railcar. Often, commuter railcars are equipped with a pneumatic leveling system causing railcar floor heights to fluctuate relative to the height of the rail platform. Finally, when track maintenance crews reset the tracks, the tracks are lifted up and a new track bed is laid down. Then the tracks are lowered on top of a higher bed thereby raising the railcar floor to ground level and causing a larger vertical gap. A study of current commuter rail systems that share tracks with freight trains and access only high-level platforms, indicated that the horizontal gap can be up to about 11 inches and the vertical gap about 6 inches. In order to bridge gaps of these dimensions, certain requirements must be met, for example, as promulgated by various governmental agencies.

In the United States, regulations have been established under the Americans with Disabilities Act (ADA) that set forth the requirements for bridging the gap between transit vehicles and platforms in various transportation facilities. The Code of Federal Regulations at 37 CFR part 1192 provides that ramps can have a slope of 1 inch in height over a length of 10 inches when bridging a maximum rise of 6 inches, a slope of between 1 inch in height to 8 inches in length, and 1 inch in height to 10 inches in length is permitted for a maximum rise of 3 inches. The ramp must also have a clear width at the surface of 30 inches and each side of the ramp must have a barrier at least 2 inches high to prevent mobility aid wheels from slipping off the side of the ramp.

In the United Kingdom, the Strategic Rail Authority published a Code of Practice in March 2005 concerning "Train and Station Services for Disabled Passengers". The Code sets forth various requirements for powered or manually operated ramps and powered lifts, including that the operator of the vehicle shall provide assistance to a disabled person in a wheelchair unless the gradient of the ramp above the horizontal plane is 8% or less. The Code also requires that a protective rim be provided along each side of the ramp at least 2" higher than the surface of the ramp.

These stipulations represent only a portion of the various regulations currently in force in the United States and United Kingdom. Presently, available step or ramp devices are solely used for wheelchair access or are not capable of automatically or manually bridging varying horizontal and vertical gaps of the magnitude found in current commuter rail systems (including those that share tracks with freight trains) and complying with the requirements of government regulations for bridging such gaps.

Manual "bridge plates" have been used for high floor-level commuter rail systems that access high-level platforms. Typically the bridge plate is a fixed device that is manually placed across a gap. Most such devices are about 29 inches wide and about 32 inches long, which means that to meet governmental requirements for ramp angles, the bridge plate cannot be used for vertical gaps that are higher than 4 inches. Using a bridge plate on a gap that is 6 inches high can be difficult and risky for people who independently drive their wheelchair onto a railcar. Also, using a manual bridge plate is time consuming and increases the potential for rail delays. Current systems require assistance to use them. Automatic wheelchair lift-type mechanisms have also been used but are complex and take up valuable railcar boarding space.

Various ramp-type systems have been disclosed in patents. U.S. Pat. No. 5,636,399 to Tremblay et al., discloses a wheelchair ramp assembly which includes a platform that is stored under or on a bus or other vehicle floor. U.S. Pat. No. 6,484,344 to Cooper, discloses a retractable access ramp which has a housing that may be coupled to steps such that a top wall of the housing is flush with a top surface of the steps. However, each of these ramp systems suffers from various deficiencies.

For instance, none of the prior art systems provides for a ramp system that can be positioned on the floor of a railcar and has a low-profile to avoid interference with passenger traffic entering and exiting the railcar. Additionally, it is important for the ramp system to be easily retrofitted into existing railcars so that these railcars can simply and inexpensively made to comply with ADA requirements.

Accordingly, a need exists for a ramp assembly that is capable of bridging varying vertical gaps of up to 6 inches or more and varying horizontal gaps of up to 12 inches or more and provides access to either of the doors on opposite sides of a railcar or other vehicle. A further need exists for a ramp that has a low-profile and can be easily retrofitted into an existing railcar.

SUMMARY OF THE INVENTION

Therefore, an object of the present invention is to provide a ramp assembly that has a low-profile while providing access to either of the doors on opposite sides of a railcar. Additionally, it is another object of the present invention to provide such a ramp assembly that can be quickly and inexpensively retrofitted into an existing railcar.

The present invention is directed to a ramp assembly including: an elongated frame sized and shaped to extend between a first door and a second door aligned opposite each other on opposed sides of a vehicle; a first sectional ramp having a first end and a second end; and a second sectional ramp having a first end and a second end. The first sectional ramp is slidably moveable along the frame from a stored position to a deployed position on either of the opposed sides of the vehicle. The second sectional ramp is positioned adjacent the first sectional ramp and is slidably moveable along the frame from a stored position to a deployed position on either of the opposed sides of the vehicle. The ramp assembly also includes a first locking mechanism coupled to the first end of each of the first sectional ramp and the second sectional ramp; and a second locking mechanism coupled to the second end of each of the first sectional ramp and the second sectional ramp. The first locking mechanism is placed in a locked position and the second locking mechanism is placed in an unlocked position to allow the first and second sectional ramps to be coupled together and moved from the stored position to the deployed position through the first door. The second locking mechanism is placed in a locked position and the first locking mechanism is placed in an unlocked position to allow the first and second sectional ramps to be coupled together and moved from the stored position to the deployed position through the second door.

The first sectional ramp and the second sectional ramp may each comprise a plurality of ramp sections pivotally connected end-to-end. The pivotal connections of the plurality of the ramp sections may be configured to control the angle of slope of the ramp sections with respect to each other when deployed.

The ramp assembly may further include a motor driven mechanism for slidably moving the first and second sectional ramps on the frame. The first and second sectional ramps may be deployed either manually or by the motor driven mechanism. The ramp assembly may further include a sensor for providing a signal indicating the presence of a person or obstacle in the path of the ramp as it extends. The sensor may also be configured to indicate the presence of a load on the ramp. The sensor may be interconnected with the motor mechanism for controlling movement of the ramp.

The first sectional ramp and the second sectional ramp may include a pair of side barriers that automatically move to an upright position when each ramp section is deployed and retract to a flat position when the ramp section is stored. The ramp assembly may further include a plurality of floor plates for covering the first sectional ramp and the second sectional ramp when the first and second sectional ramps are stored.

The first locking member and the second locking member may be substantially wedge-shaped thereby providing a smooth transition between a surface and the first and second ramp sections. The first locking member and the second locking member may be locked and unlocked manually, mechanically, electronically, pneumatically or any combination thereof.

The present invention is also directed to a ramp assembly including: a frame section configured to be positioned on the floor of a vehicle; a first sectional ramp having a first end and a second end; and a second sectional ramp having a first end and a second end. The first sectional ramp is slidably positioned within the frame, and the second sectional ramp is slidably positioned within the frame adjacent to the first sectional ramp. The first end of the first sectional ramp is coupled to the first end of the second sectional ramp to slidably deploy the first sectional ramp and the second sectional ramp in a first direction and the second end of the first sectional ramp is coupled to the second end of the second sectional ramp to slidably deploy the first sectional ramp and the second sectional ramp in a second direction.

The first sectional ramp and the second sectional ramp may each comprise a plurality of ramp sections pivotally connected end-to-end. The pivotal connections of the plurality of the ramp sections may be configured to control the angle of slope of the ramp sections with respect to each other when deployed.

The ramp assembly may further include a plurality of floor plates for covering the first sectional ramp and the second sectional ramp when the first and second sectional ramps are stored. The first end of the first sectional ramp and the first end of the second sectional ramp may be coupled together by a first locking member and the second end of the first sectional ramp and the second end of the second sectional ramp may be coupled together by a second locking member. The first locking member and the second locking member may be substantially wedge-shaped thereby providing a smooth transition between a surface and the first and second ramp sections. The first locking member and the second locking member may be locked and unlocked manually, mechanically, electronically, pneumatically or any combination thereof.

The present invention is also a ramp assembly including: an elongated frame sized and shaped to extend between corresponding doors aligned opposite each other on opposed sides of a vehicle; and a sectional ramp slidably movable along the frame from a stored position to deployed positions of adjustable lengths and angles on either of the opposed sides of the vehicle.

Additionally, the present invention is directed to a method of retrofitting a railcar with a ramp. The railcar includes a body with a first side, a second side opposed to the first side, a floor, at least a first door positioned on the first side and a second door positioned on the second side and aligned opposite the first door and seats positioned on the floor of the railcar. The method includes the steps of: providing a ramp assembly having: an elongated frame sized and shaped to extend between the first door and the second door; a first sectional ramp having a first end and a second end; a second sectional ramp having a first end and a second end; a first locking mechanism coupled to the first end of each of the first sectional ramp and the second sectional ramp; and a second locking mechanism coupled to the second end of each of the first sectional ramp and the second sectional ramp. The first sectional ramp is slidably moveable along the frame from a stored position to a deployed position on either of the opposed sides of the railcar. The second sectional ramp is positioned adjacent the first sectional ramp section and slidably moveable along the frame from a stored position to a deployed position on either of the opposed sides of the railcar. The method also includes the steps of positioning the elongated frame of the ramp assembly on the floor of the railcar between the first door and the second door aligned opposite each other on opposed sides of the vehicle; coupling the elongated frame of the ramp assembly to the floor of the vehicle; and coupling a motor driven mechanism positioned on a wall surface, ceiling or floor pocket of the vehicle to the ramp assembly for slidably moving the first and second sectional ramps on the frame.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE PRESENT INVENTION

Figure 1:
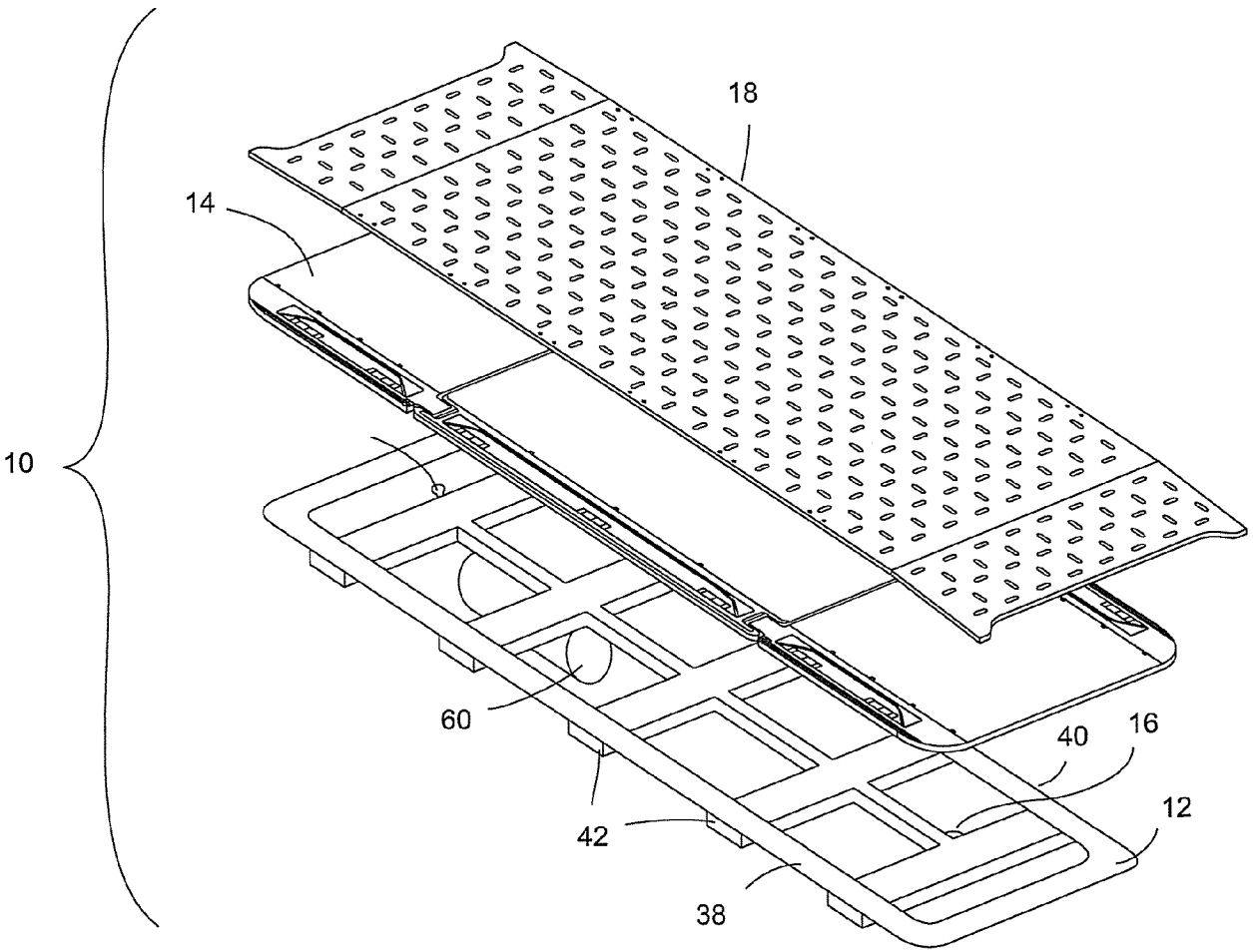
FIG. 1 is an exploded view of a first embodiment of a ramp assembly including a frame, a sectional ramp slidably movable back and forth over either end of the frame, and a motor and drive mechanism for moving the ramp in accordance with the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
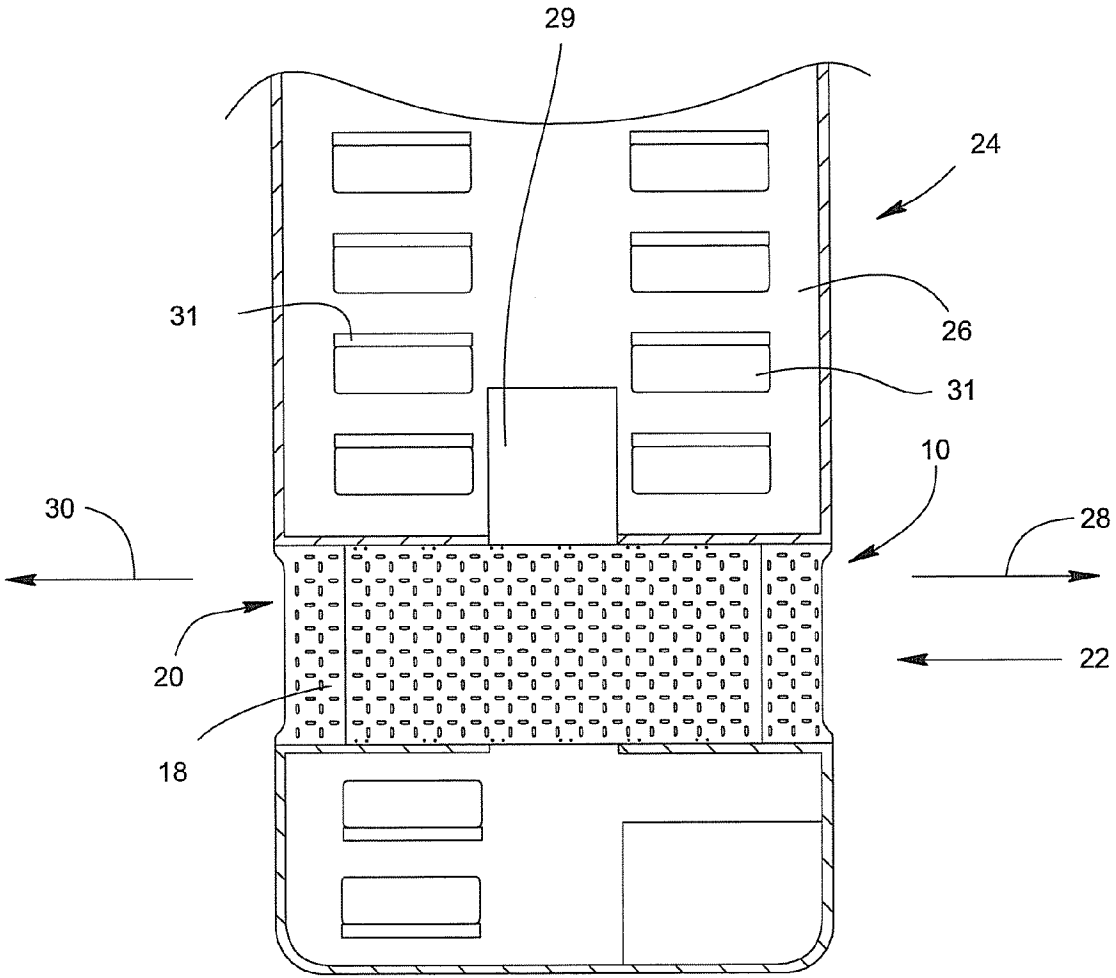
FIG. 2 is a side elevation view of a vehicle showing the ramp assembly extending between corresponding doors on opposed sides of the vehicle with the ramp in a stored position.

With reference to FIG. 1, a ramp assembly, denoted generally as reference numeral 10, includes an optional frame structure 12, a sectional ramp 14 and a drive mechanism 60. Sectional ramp 14 may be covered with a floorplate structure having a sectional floor plate 18 covering ramp assembly 10. As shown in FIG. 2, which is a top view of a railcar 24, the ramp assembly is adapted to extend lengthwise between corresponding doorways 20 and 22 located opposite each other on opposed sides of a railcar 24 or other mode of transportation. The ramp assembly may be positioned towards the end of the railcar or other vehicle, or at any other location in the vehicle. Sectional floor plate 18 may fit flush with the adjacent floor 26 of the vehicle or, alternatively, somewhat above the floor 26. In embodiments where sectional floor plate 18 is positioned above railcar floor 26, an optional side ramp 29 may be positioned in the car between seats 31 in order to provide a smooth transition from sectional floor plate 18 to railcar floor 26. Optionally, depending on the location of the ramp assembly within the railcar, multiple side ramps 29 may be positioned on one or both sides of ramp assembly 10.

Figure 4:
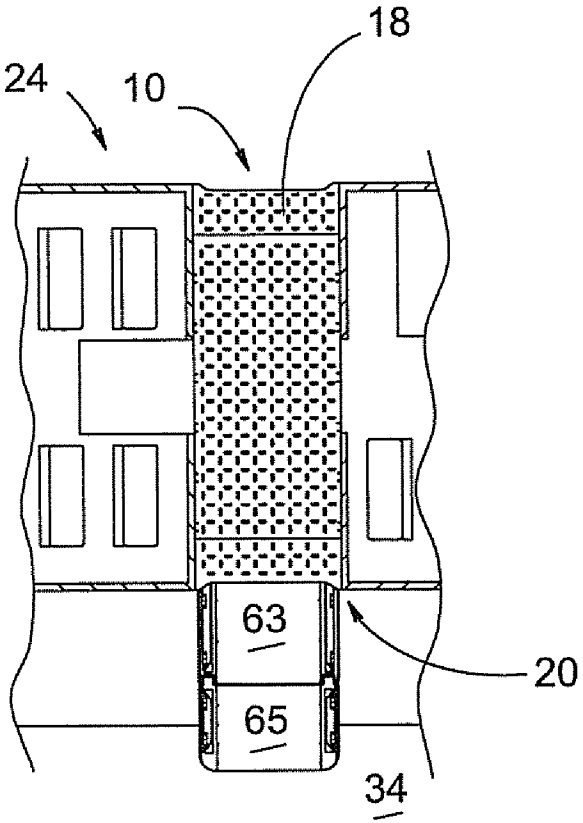
FIG. 4 is a side elevation view of the vehicle of FIG. 2 with two sections of the ramp deployed so as to extend from a doorway of the vehicle to a platform adjacent the vehicle.
Figure 3:
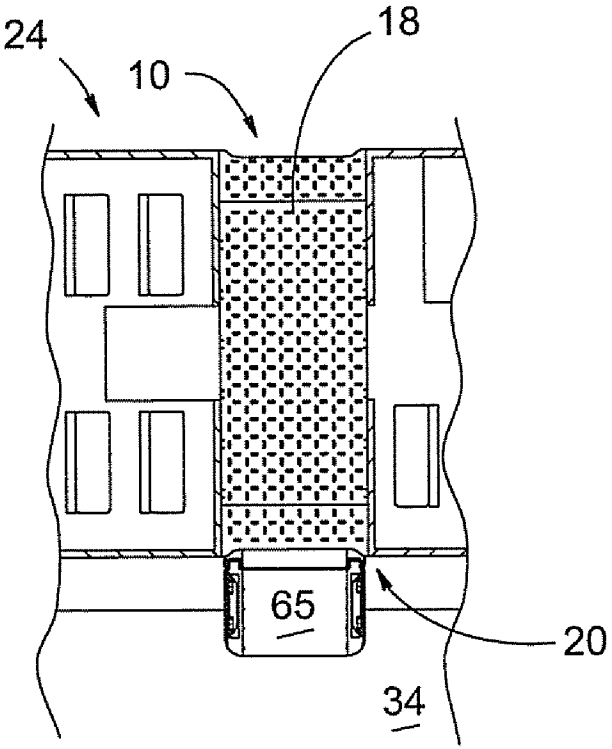
FIG. 3 is a side elevation view of the vehicle of FIG. 2 with one section of the ramp deployed so as to extend from a doorway of the vehicle to a platform adjacent the vehicle.

Sectional ramp 14 is slidably movable on optional frame structure 12, which may be mounted to a structure of the vehicle, to various deployed positions adjacent either doorway 20 or doorway 22 of the vehicle as shown by arrows 28 and 30, respectively. For example, FIG. 3 illustrates a first section 65 of the ramp deployed so as to extend from doorway 20 to platform 34. FIG. 4 illustrates two sections 63 and 65 of the ramp deployed so as to extend from doorway 20 to platform 34. Each section of the ramp may be either partially or fully deployed (i.e., each section of the ramp may be deployed so as to extend only partially from the end of the frame or fully beyond the end of the frame).

Sectional ramp 14 may be provided separately from frame 12. For example, the vehicle may have a frame structure built in as part of the original equipment or the vehicle may be modified to include a frame structure. Various components associated with the frame, such as a motor mechanism, may also be provided on the vehicle separately from ramp 14.

Figure 5:
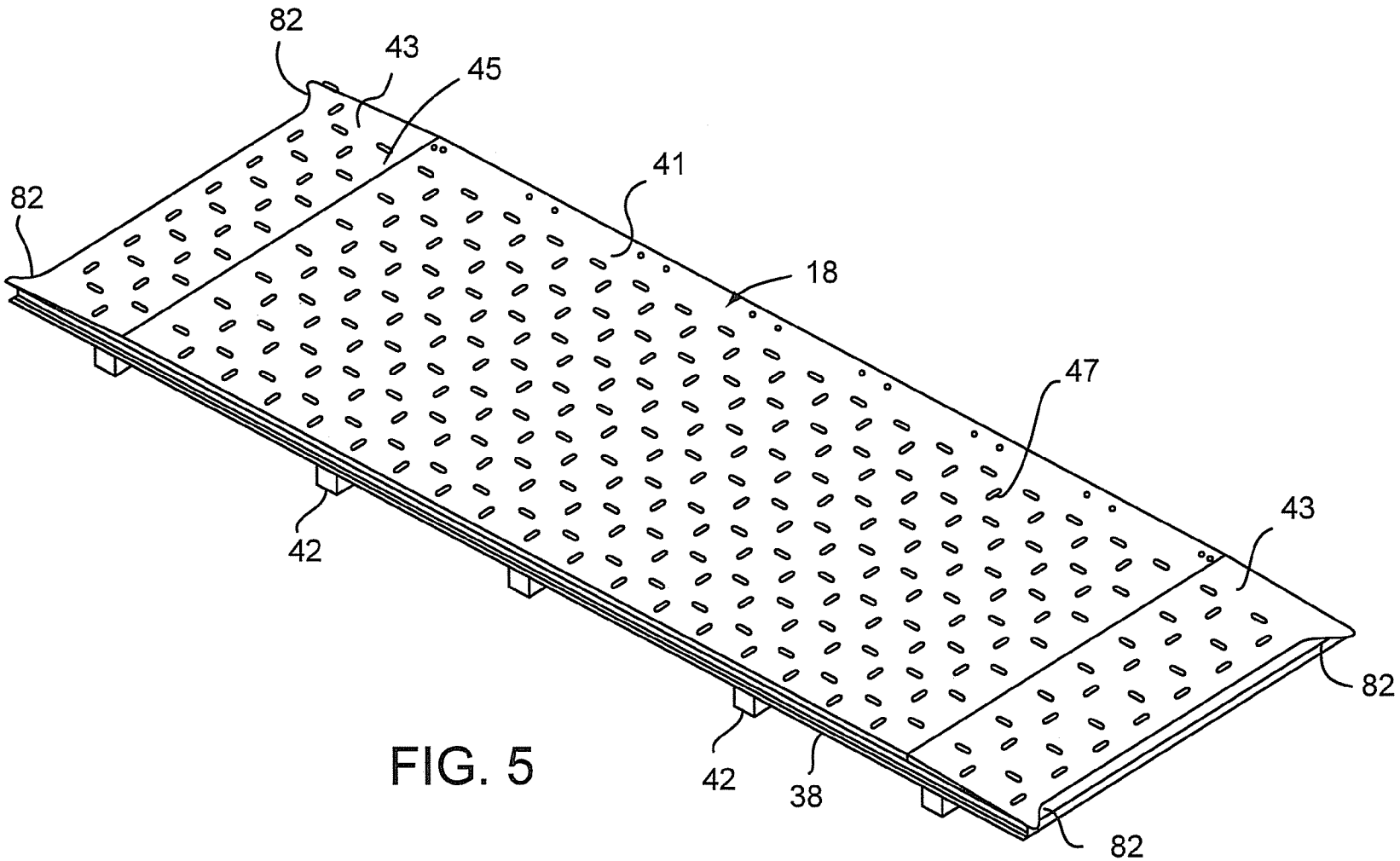
FIG. 5 is a perspective view of the ramp assembly of FIG. 1 with a sectional floor plate covering the sectional ramp.

With reference to FIG. 5, sectional floor plate 18 covers sectional ramp 14 and may include a center section 41 and opposed end sections 43. End sections 43 are pivotally attached to center section 41 at a plurality of locations 45 so as to form a transition surface to ramp 14 when ramp 14 is deployed. Each section of floor plate 18 may have a non-slid surface comprised of raised protrusions 47. Sectional floor plate 18 may be composed of a material such as, but not limited to, metal or plastic. Additionally, in some embodiments sectional floor plate 18 may be manufactured in a dual convex fashion that serves both to add strength and aid in achieving the desired entry angle for the required length and height requirements. Although FIG. 5 illustrates a single center section 41 and two end sections 43, any number of sections may be used, and any of the sections shown in FIG. 5 may be further subdivided into subsections.

Figure 8:
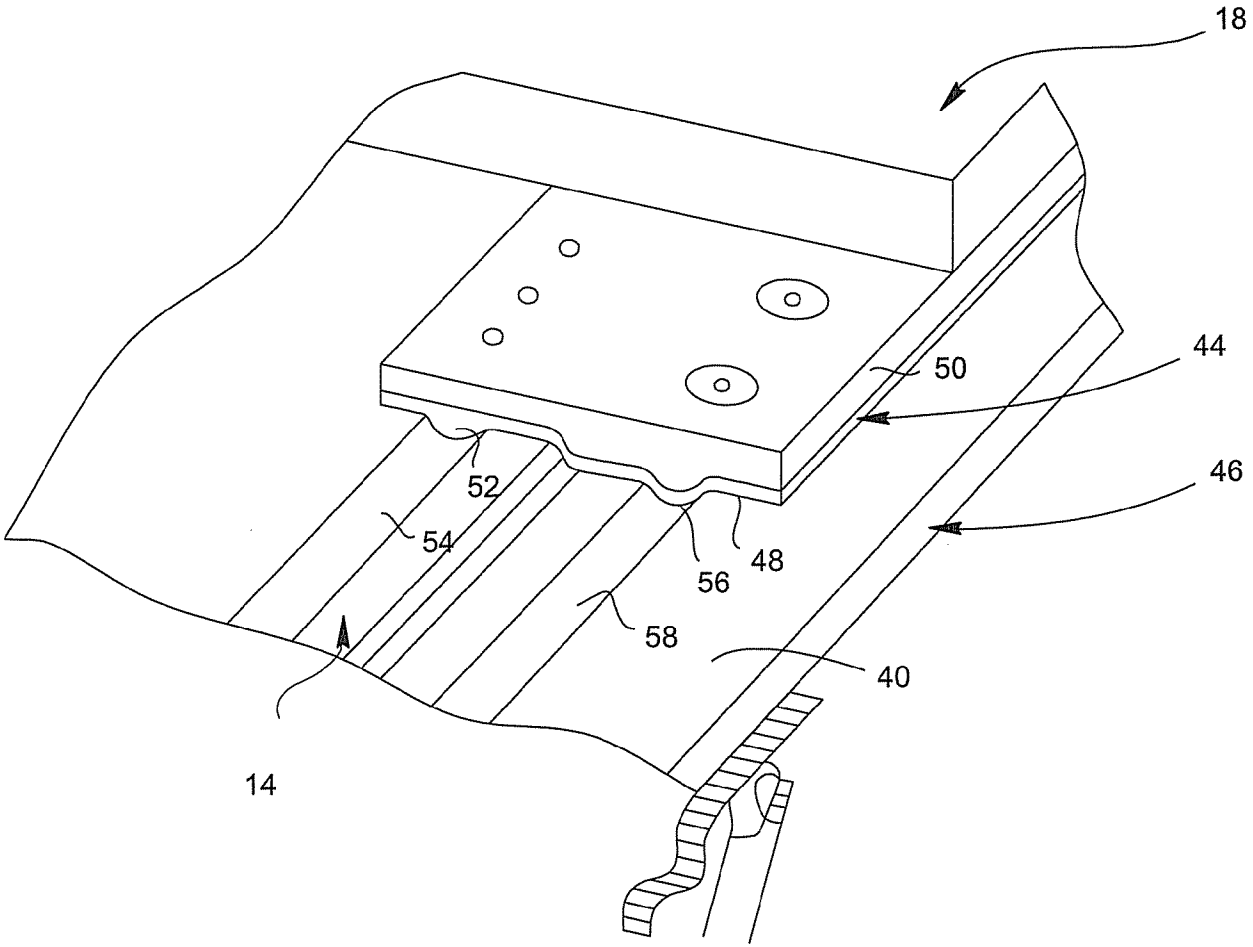
FIG. 8 is a view of a portion of the sectional ramp of FIG. 5 with part of the floor plate removed so as to show an upper bearing between the ramp and frame.

With continued reference to FIG. 1, in some embodiments frame structure 12 includes side pieces 38 and 40 connected by a plurality of spaced cross pieces 42. Side pieces 38 may be a single elongate piece or a plurality of separate pieces connected end-to-end. The frame may be constructed of plates, sheets, bars, rods or other shapes and may be made of various materials or in various other configurations. Referring to FIG. 8, each side piece may have a plurality of upper and lower bearings 44 and 46 spaced along the length of the side piece. Bearings 44 and 46 facilitate slidable movement of sectional ramp 14 in either of two opposed directions off the end of frame 12. Any type of bearing such as roller, ball or other mechanism that allows for linear movement of sectional ramp 14 may be used. In various embodiments, the bearing may comprise a plate of material having a low co-efficient of friction, for example, a polymer such as nylon. Upper bearing 44 shown in FIG. 8 comprises a nylon plate 48 mounted on a flange 50 of side piece 40 and having a protrusion 52 riding in a channel 54 of ramp section 65. Although not required, nylon plate 48 may have a second protrusion 56 riding in channel 58 of the side piece 40. The form and construction of bearings is not critical to operation of ramp assembly 10.

Figure 6:
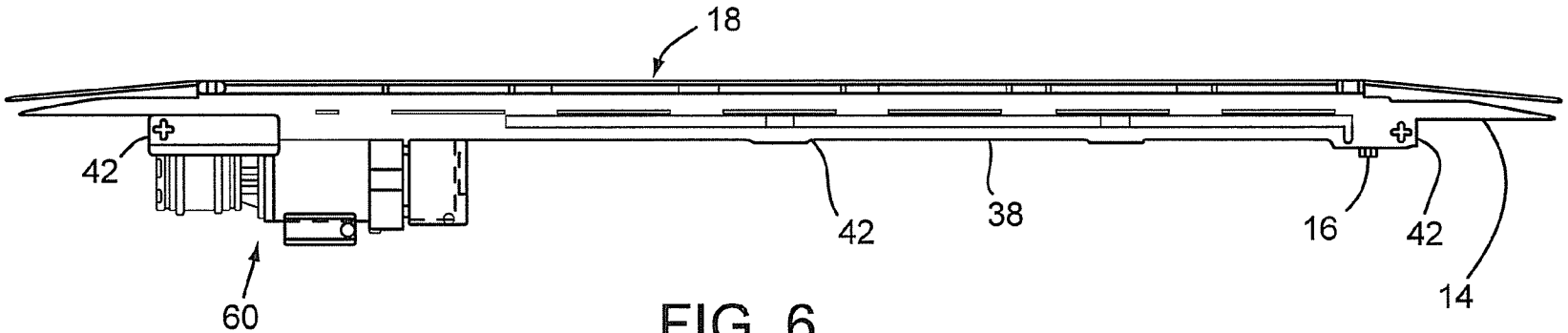
FIG. 6 is a side view of the ramp assembly of FIG. 5.

With reference to FIG. 6 and with continuing reference to FIG. 1, in some embodiments ramp assembly 1 include a drive mechanism or mechanisms 60 for slidably moving sectional ramp 14 on frame structure 12. Drive mechanism 60 may include a single reversible motor or, alternatively, two separate motors may be provided for moving sectional ramp 14 in opposite directions. The motor may be electric, hydraulic or other type of motor. Additionally, the motor may be positioned outside of ramp assembly 1 on a wall surface, ceiling or in a floor pocket. In various embodiments the motor is provided with a clutch that automatically disengages in the event of a power failure so that the ramp may be manually deployed. A controller (not shown) may be connected to the motor to allow adjustment of the deployment speed of sectional ramp 14. Drive mechanism 60 may be a chain or belt or cable wound around any number of sprockets such as 16, a cable wound around pulleys or various gear mechanisms. In other embodiments, a motor and drive mechanism may not be used and are not required. The ramp is adapted to move outwardly from either one doorway or the opposite doorway of railcar 24 or other vehicle. This eliminates the need for separate ramp assemblies for each doorway of the car. In some embodiments, ramp assembly 10 includes a single, bi-directional ramp made up of a plurality of sections that are substantially in a single plane when retracted. However, alternatively the ramp assembly may include a single frame structure with at least two separate ramps, such that one ramp moves outwardly in one direction and another ramp moves outwardly in another direction. For example, one ramp may be mounted above another in the frame, with each ramp having a plurality of sections substantially on a single plane when retracted.

Figure 7:
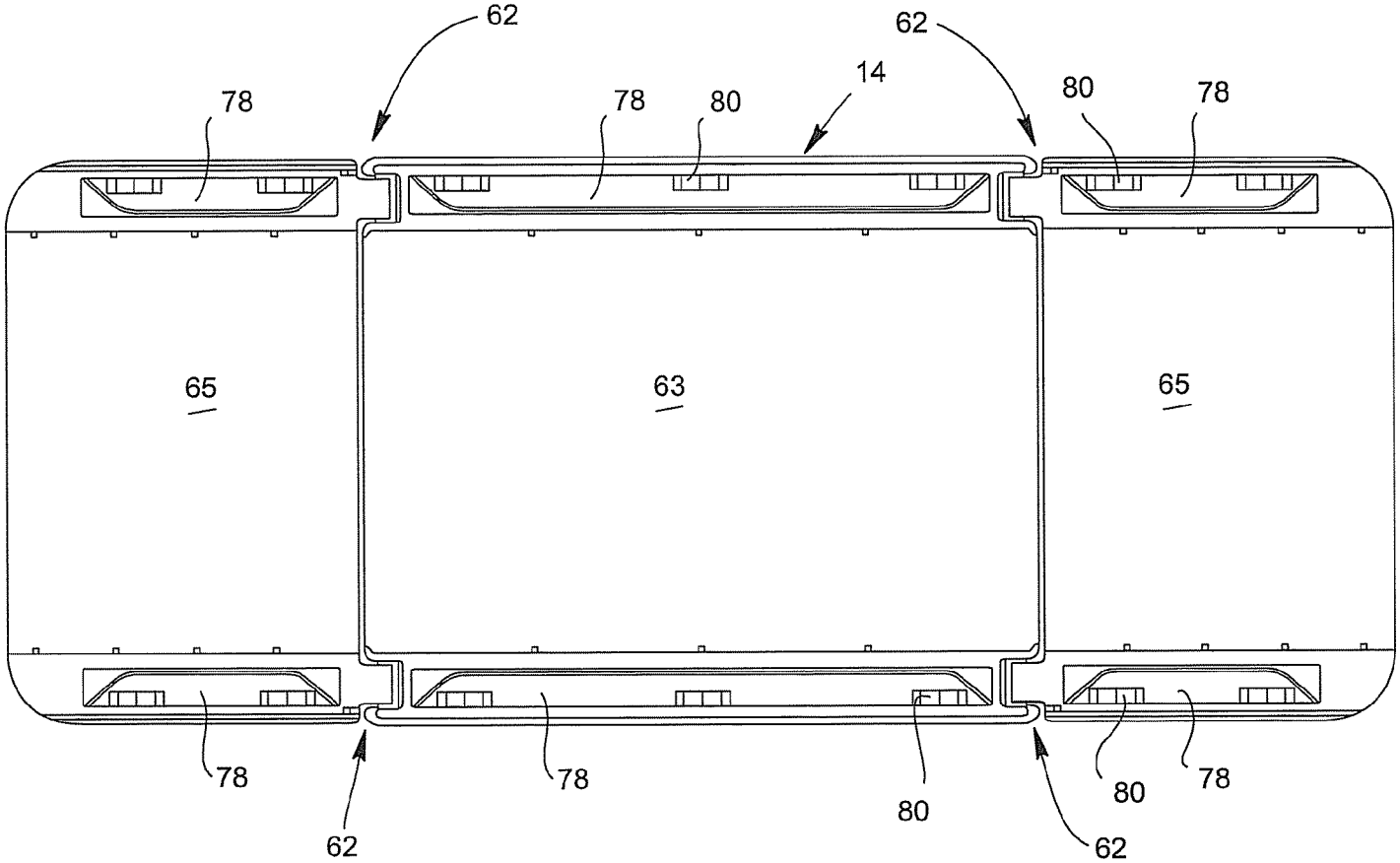
FIG. 7 is a plan view of the movable ramp with side rails of the sectional ramp assembly of FIG. 5.

With reference to FIG. 7 and with continuing reference to FIG. 1, sectional ramp 14 includes a plurality of ramp sections 63, 65 pivotally connected in an end-to-end relationship. All of ramp sections 63, 65 in the embodiments shown are aligned in the same plane, or substantially in the same plane, when in the retracted or stored position. Each of ramp sections 63, 65 is provided with a non-slip surface, which may comprise a roughened surface of the ramp itself, or a separate rough surface material applied to the surface of the ramp. Any number of ramp sections 63, 65 may be used and the length of the ramp sections may vary depending on the vertical and horizontal gap between the doorway and platform or ground to be spanned by the ramp.

FIGS. 1 and 7 illustrate a ramp that includes a center section 63 and opposed end sections 65. Center section 63, for example, in one embodiment is about 6 feet long and each end section 65 is about 2 feet long. This configuration is believed suitable for spanning vertical gaps up to 6 inches and horizontal gaps of up to 12 inches. However, other configurations may be used, for example, to span larger or smaller vertical and horizontal gaps, or to use a greater number of sections or sections of different lengths. Generally, the width of the ramp sections is about 3 feet in order to allow convenient access by passengers in wheelchairs as well as other passengers. Individual ramp sections may be removable to allow any section to be interchanged for maintenance, as well as to allow length and width changes for various car sizes and manufacturers. The ramp is desirably not wider than the door of railcar 24. For very long ramps, extra support may be needed to keep the ramp level as it extends until it reaches the ground, platform or other surface. For example, a cable may extend over a pulley or other device on the vehicle to the front or outer end of the ramp, or to another appropriate position on the ramp, so as to keep the ramp level or otherwise support the ramp until it reaches the desired extended position. Alternatively, a retractable bar may be provided underneath the ramp to keep the ramp level as it extends, the bar being retractable when the ramp reaches the extended position. Additional support may also be needed for the middle of a very long ramp and could be provided by a stool, block or other support placed manually under the ramp as or after it extends, or by a retractable or pivotal support mounted on the ramp itself.

In some embodiments, sensors may be provided to prevent the ramp from contacting a person or obstacle while the ramp is being extended. For example, an optical sensor may be provided at the front or outermost end of the ramp for this purpose. Alternatively, a pressure-type sensor may be provided to stop or retract the ramp if the ramp contacts a person or obstacle. In both cases, the sensor would be interconnected with the motor control switch to control movement of the ramp in response to a signal from the sensor. In various other embodiments a load sensor may be provided to prevent movement of the ramp if a weight, such as a person or object, is on the ramp. The load sensor would also be interconnected with the motor control switch.

Figure 9:
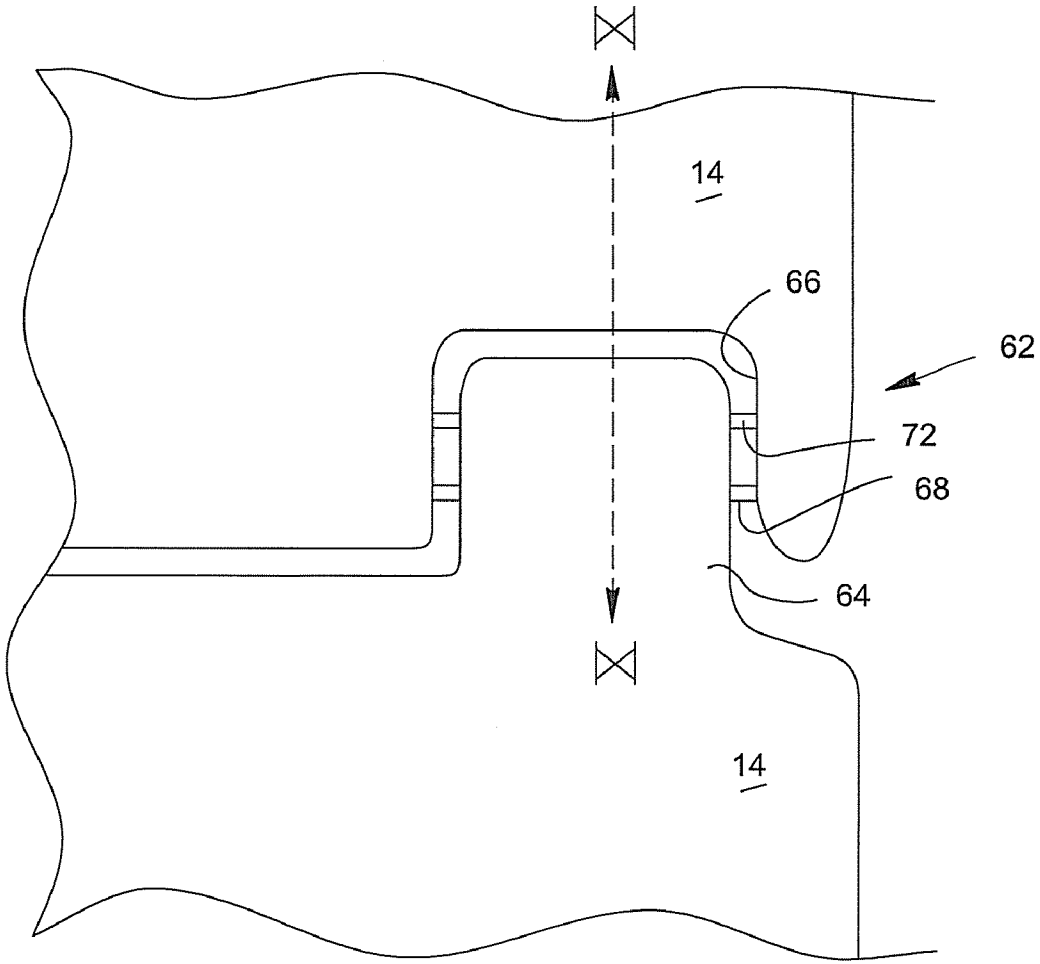
FIG. 9 illustrates an exemplary interlocking mechanism for the pivotal connection of two ramp sections.
Figure 10:
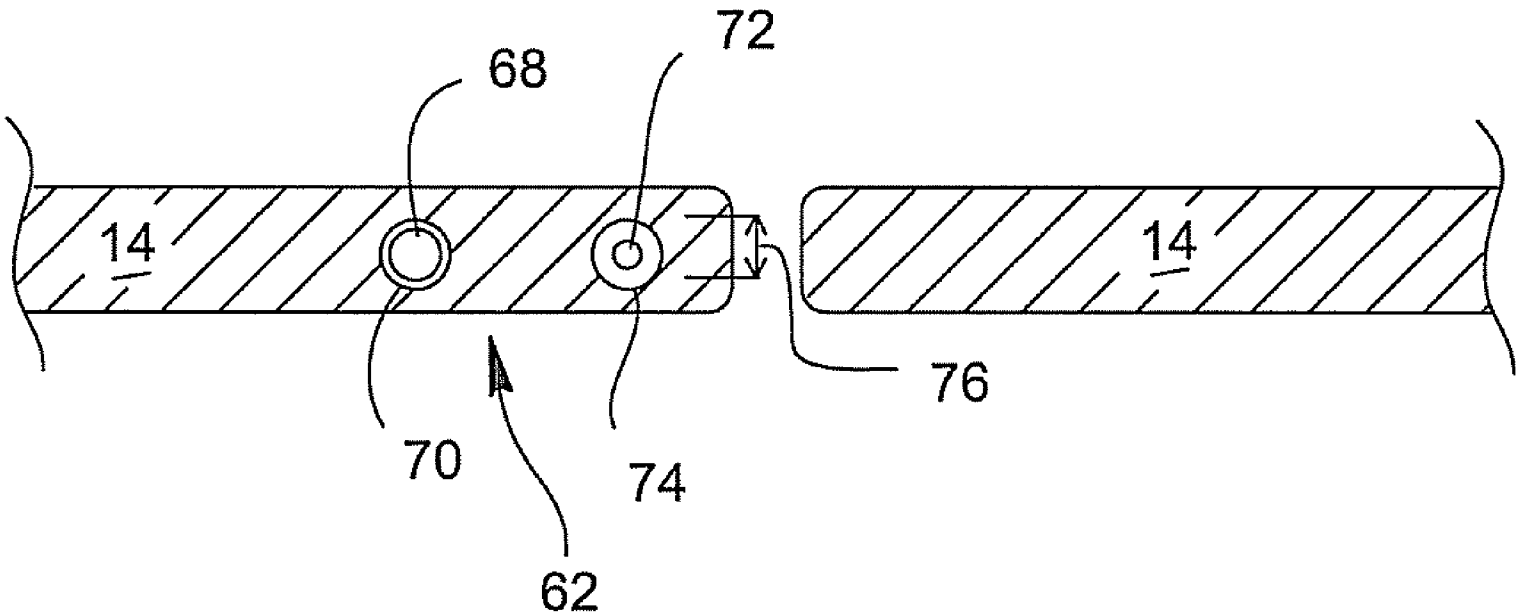
FIG. 10 is a sectional view taken at X-X of FIG. 9.

The ramp sections are pivotally connected by one or more pivotal connections 62 such as those shown in FIGS. 7, 9 and 10. In some embodiments, referring to FIGS. 9 and 10, one of the ramp sections has at least one arm portion 64 extending into a recess 66 of an adjacent ramp section. A first pin 68 mounted in the walls of the recess extends through a first hole 70 in arm 64 to allow the ramp sections to pivot with respect to each other. In various embodiments, a second pin 72 is mounted in the walls of the recess and extends through a second hole 74 that has diameter 76, somewhat greater than the diameter of pin 72, for limiting the maximum pivotal movement of the ramp sections or achieving the desired angle of the ramp sections when the outer end of the ramp contacts the ground, platform or other surface. Other means for limiting the angular movement or achieving the desired angle of the ramp sections may also be used, for example, such as stops provided at specific locations for this purpose. Controlling the angular relationship of the ramp sections assures that the ramp will comply with governmental regulations for access by persons in wheelchairs and by other persons with various disabilities.

With reference to FIG. 7, one or more of the ramp sections may have one or more side barriers 78 which serve to reduce the likelihood that wheelchairs will fall off the ramp. In some embodiments, side barriers 78 may be at least about 2 inches high to provide a barrier on ramps used for wheelchair access. FIG. 7 shows side barriers 78 in a flat position, which is the position of side barriers 78 when sectional ramp 14 is stored beneath floor plates 18. Side barriers 78 can be moved to a raised position which is the normal position of side barriers 78 when each ramp section is deployed. In some embodiments, each side barrier 78 has one or more spring mechanisms 80 or other hydraulic, pneumatic or other mechanical means for automatically raising side barrier 78 from a flat position to a raised position when the ramp section is moved from a stored position to a deployed position. Side barriers 78 may also be automatically retracted when sectional ramp 14 is moved from a deployed position to the stored position. As shown in FIG. 5, outer edge 82 of each end plate 43 may have an angular shape for contact with an angular surface of each side barrier 78 so as to retract side barrier 78 to a flat position when sectional ramp 14 is moved to the stored position.

Figure 11:
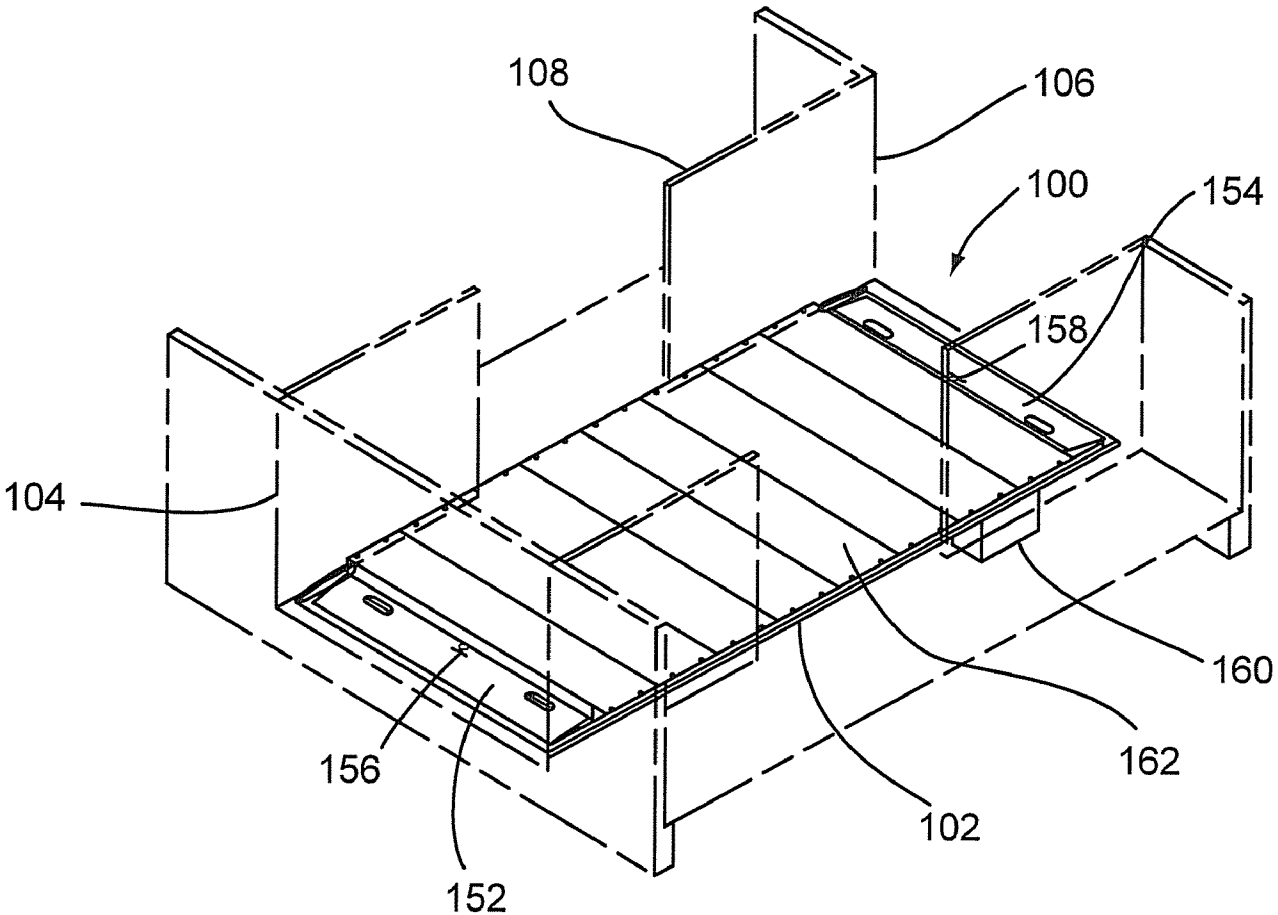
FIG. 11 is a perspective view of another embodiment of a ramp assembly extending between corresponding doors on opposed sides of a vehicle with the ramp in a stored position in accordance with the present invention.
Figure 12:
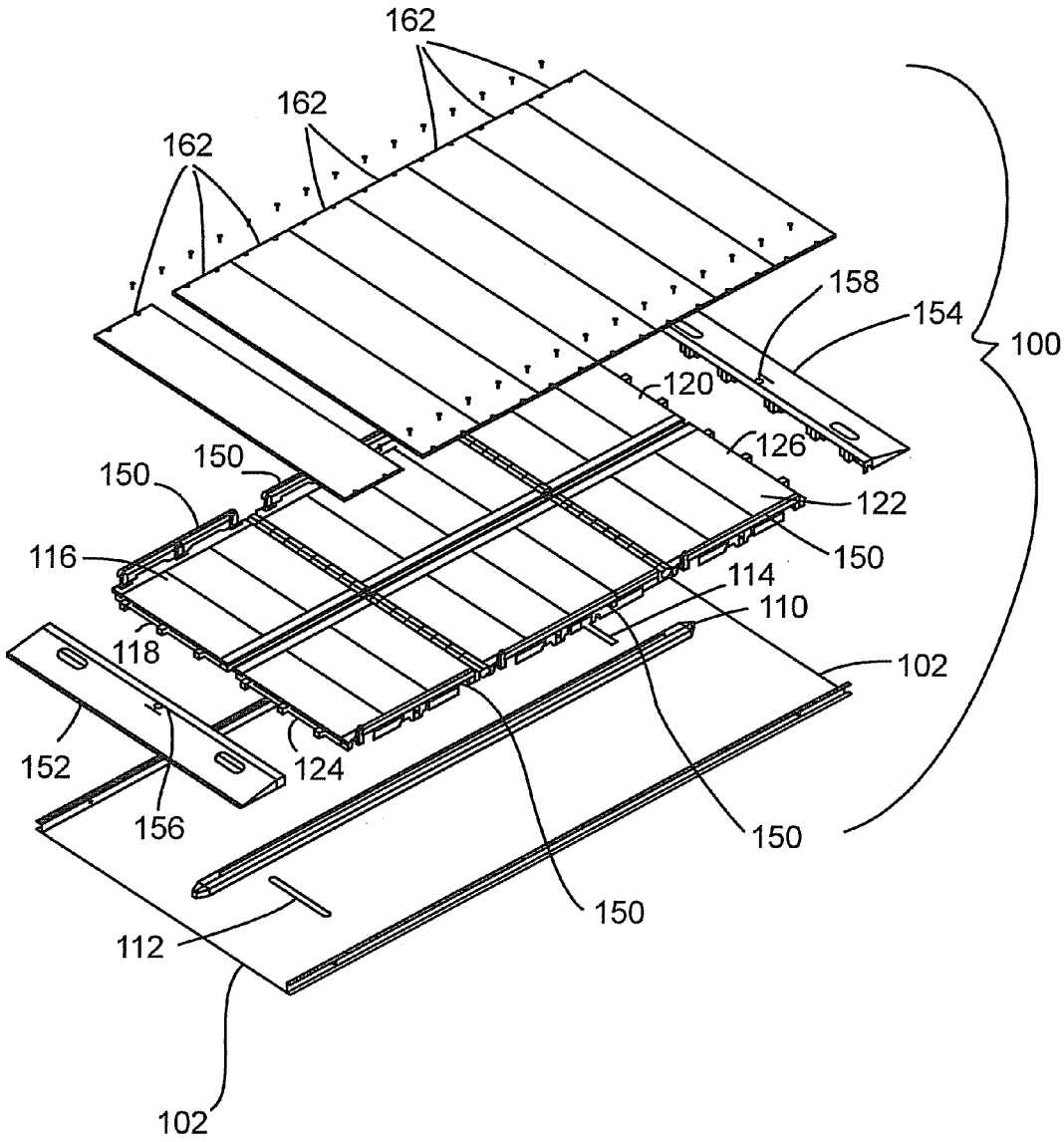
FIG. 12 is an exploded view the ramp assembly of FIG. 11.

With reference to FIGS. 11 and 12, an alternative embodiment of ramp assembly, denoted generally as reference numeral 100, which has a low-profile and can easily be integrated in new construction or added on to existing construction modes of transport. Ramp assembly 100 includes an elongated frame 102 sized and shaped to extend between a first door 104 and a second door 106 aligned opposite each other on opposed sides of a vehicle 108. Elongated frame 102 includes a central rail 110, a first stop block 112 and a second stop block 114. Elongated frame 102 may be constructed as a single unitary plate or may be constructed from two or more sections. Elongated frame 102 may be constructed from stainless steel, aluminum, brass or any other suitable material.

Ramp assembly 100 also includes a first sectional ramp 116 having a first end 118 and a second end 120 and a second sectional ramp 122 having a first end 124 and a second end 126. First sectional ramp 116 is slidably moveable along frame 102 from a stored position to a deployed position on either of the opposed sides of vehicle 108. Second sectional ramp 122 is positioned adjacent first sectional ramp 116 and is slidably moveable along frame 102 from a stored position to a deployed position on either of the opposed sides of the vehicle. Central rail 110 of frame 102 is positioned between first sectional ramp 116 and second sectional ramp 122 to ensure that each of the sectional ramps remains in the proper position.

Figure 13:
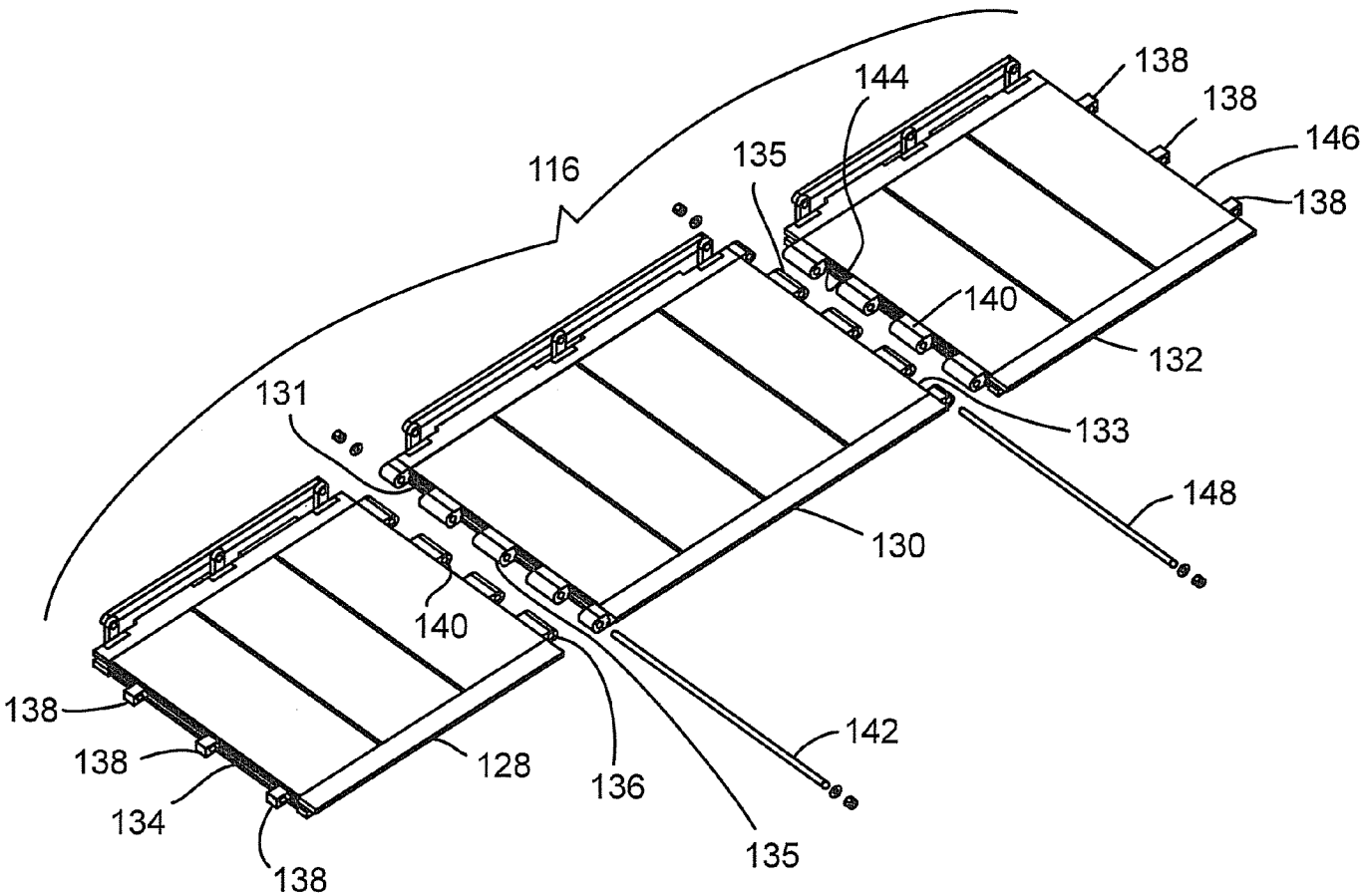
FIG. 13 is a perspective, exploded view of a sectional ramp of the ramp assembly of FIG. 11.

Each of the sectional ramps includes a plurality of ramp sections. For example and with reference to FIG. 13, first sectional ramp 116 and second sectional ramp 122 each include a first ramp section 128, a second ramp section 130 and a third ramp section 132. Second ramp section 130 includes a first end 131 with male hinges 135 coupled thereto and a second end 133 with male hinges 135 coupled thereto. First ramp section 128 includes a first end 134 and a second end 136. First end 134 of first ramp section 128 includes socket members 138 which are adapted to be coupled to a locking mechanism as will be discussed in greater detail hereinafter. Second end 136 of first ramp section 128 includes female hinge members 140 adapted to be coupled to male hinges 135 of first end 131 of second ramp section 130 via rod 142, thereby pivotally connecting first ramp section 128 and second ramp section 130. Third ramp section 132 includes a first end 144 and a second end 146. First end 144 of second ramp section 136 includes socket members 138 which are adapted to be coupled to a locking mechanism as will be discussed in greater detail hereinafter. Second end 146 of second ramp section 136 includes female hinge members 140 adapted to be coupled to male hinges 135 of second end 133 of second ramp section 130 via rod 148 thereby pivotally connecting second ramp section 130 and third ramp section 132. The pivotal connection provided by the coupling between male hinges 135 and female hinges 140 is specially designed to control the angle of slope of the ramp sections with respect to each other when deployed thereby limiting the degree of rotation of each ramp section relative to the others to comply with ADA requirements. Each of the ramp sections is provided with a non-slip surface, which may comprise a roughened surface of the ramp itself, or a separate rough surface material applied to the surface of the ramp. Each ramp section 128, 130 and 132 is provided with retractable side barriers 150 which serve to reduce the likelihood that wheelchairs will fall off the ramp. Side barriers 150 may be locked when the ramp is in an extended position using a lock mechanism such as a pin, cam or other type of lock.

Ramp assembly 100 also includes a first locking mechanism 152 that is configured to be coupled to socket members 138 of first end 118 of first sectional ramp 116 and socket members 138 of first end 124 of second sectional ramp 122 and a second locking mechanism 154 that is configured to be coupled to socket members 138 of second end 120 of first sectional ramp 116 and socket members 138 of second end 126 of second sectional ramp 122. Each locking mechanism 152 and 154 is substantially wedge-shaped thereby providing a smooth transition between a surface and first sectional ramp 116 and second sectional ramp 122. First locking mechanism 152 and second locking mechanism 154 each include a locking device 156 and 158 that is configured to move from a locked position to an unlocked position. When locking device 156 is in the locked position, it couples to socket members 138 of first end 118 of first sectional ramp 116 and socket members 138 of first end 124 of second sectional ramp 122 thereby creating a unitary, slidably movable unit between first locking mechanism 152, first sectional ramp 116 and second sectional ramp 122. When locking device 158 is in the locked position, it couples to socket members 138 of second end 120 of first sectional ramp 116 and socket members 138 of second end 126 of second sectional ramp 122 thereby creating a unitary, slidably movable unit between second locking mechanism 154, first sectional ramp 116 and second sectional ramp 122. Locking devices 156 and 158 may be locked and unlocked manually, mechanically, electronically, pneumatically or any combination thereof.

The first and second sectional ramps 116, 122 may be deployed either manually or by a motor driven mechanism 160. The motor driven mechanism 160 may be coupled to ramp assembly 100 for slidably moving the first and second sectional ramps 116, 122 on frame 12. The motor driven mechanism 160 may be positioned within ramp assembly 100 as shown in FIG. 11 or on a wall surface, ceiling or floor pocket of vehicle 108.

Ramp assembly 100 may further include a plurality of floor plates 162 for covering first sectional ramp 116 and second sectional ramp 122 when the first and second sectional ramps are stored. Each floor plate 162 may have a non-skid surface comprised of raised protrusions. Floor plates 162 may be composed of a material such as, but not limited to, metal or plastic. Additionally, in some embodiments floor plates 162 may be manufactured in a dual convex fashion that serves both to add strength and aid in achieving the desired entry angle for the required length and height requirements.

With reference to FIG. 11, ramp assembly 100 is configured having a width that is the same as the width of first door 104 and second door 106 of vehicle 108. Accordingly, ramp assembly 100 may have a width of approximately 32 inches which corresponds to doors at either end of a railcar, or approximately 53 inches which corresponds to the double door commonly found in the center of the railcar. Accordingly, first sectional ramp 116 and second sectional ramp 122 can be sized and/or spaced within the doors to accommodate the different sized doorways commonly found on railcars and other vehicles. However, these widths are not to be construed as limiting as ramp assembly 100 can be configured to have a width that is smaller or larger than these values and can be positioned to a width that is less than the width of the doors of the vehicle.

In operation, if a user wants to deploy the ramp through first door 104, locking device 156 of first locking mechanism 152 is placed in a locked position and locking device 158 of second locking mechanism 154 is placed in an unlocked position thereby creating a unitary, slidably movable unit between first locking mechanism 152, first sectional ramp 116 and second sectional ramp 122. This unitary, slidably movable unit is then moved from a stored position to a deployed position through first door 104 either manually or by motor driven mechanism 160. If the user wants to deploy the ramp through second door 106, locking device 158 of second locking mechanism 154 is placed in a locked position and locking device 156 of first locking mechanism 152 is placed in an unlocked position thereby creating a unitary, slidably movable unit between second locking mechanism 154, first sectional ramp 116 and second sectional ramp 122.

This unitary, slidably movable unit is then moved from a stored position to a deployed position through second door 106 either manually or by motor driven mechanism 160.

The above described design of ramp assembly 100 allows ramp assembly 100 to have a low-profile while maintaining structural integrity. For instance, ramp assembly 100 has a height that extends about 2 inches to about 2.5 inches above the floor of vehicle 108. First sectional ramp 116 and second sectional ramp 122 are able to be constructed from a thin sheet of material and still support the required load without suffering from deflection since the load is distributed between first sectional ramp 116 and second sectional ramp 122. If a single ramp structure where used as discussed in previous embodiments above, such low-profiles would not be able to be obtained.

Additionally, another embodiment of the retractable ramp 100 may be employed without first locking mechanism 152 and second locking mechanism 154. In this embodiment, first sectional ramp 116 and second sectional ramp 122 may be deployed, either sequentially or simultaneously, through either first door 104 or second door 106 of vehicle 108. Further, the first and second sectional ramps 116, 122 may be deployed either manually or by a motor driven mechanism.

The retractable ramp embodiments described herein may be integrated in new construction or added on to existing construction modes of transport. The retractable ramps described herein may be retrofitted into an existing railcar without any the need for modifications to the structural frame members of the railcar. For instance, the longitudinal I-beams that run underneath typical railcars would not have to be adapted, reconfigured or removed in order to install the retractable ramps disclosed herein.

Railcars, busses, subways, boats or any other mode of transportation may be equipped with a retractable ramp as described herein. The ramp also may be used as a bridging device during emergency evacuations from railcars or other vehicles. In addition, the ramp may be used as a bridging structure for activities such as train-to-train, boat-to-boat or other vehicle-to-vehicle or vehicle-to-ground transfer.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A ramp assembly comprising:

a frame section configured to be positioned on the floor of a vehicle;

a first sectional ramp having a first end and a second end, the first sectional ramp slidably positioned within the frame; and a second sectional ramp having a first end and a second end, the second sectional ramp slidably positioned within the frame adjacent to the first sectional ramp, wherein the first sectional ramp is slidably moveable along the frame from a stored position to a deployed position on either of the opposed sides of the vehicle, and the second sectional ramp is slidably moveable along the frame from a stored position to a deployed position on either of the opposed sides of the vehicle.

2. The ramp assembly of claim 1, wherein the first sectional ramp and the second sectional ramp each comprise a plurality of ramp sections pivotally connected end-to-end.

3. The ramp assembly of claim 2, wherein the pivotal connections of the plurality of the ramp sections control the angle of slope of the ramp sections with respect to each other when deployed.

4. The ramp assembly of claim 1 further comprising a plurality of floor plates for covering the first sectional ramp and the second sectional ramp when the first and second sectional ramps are stored.

5. The ramp assembly of claim 1, wherein the first end of the first sectional ramp and the first end of the second sectional ramp are coupled together by a first ramp member and the second end of the first sectional ramp and the second end of the second sectional ramp are coupled together by a second ramp member.

6. The ramp assembly of claim 5, wherein the first ramp member and the second ramp member are substantially wedge-shaped thereby providing a smooth transition between a surface and the first and second sectional ramps.

7. The ramp assembly of claim 1, further comprising a motor driven mechanism for slidably moving the first sectional ramp and the second sectional ramp on the frame.

8. The ramp assembly of claim 7, wherein the first sectional ramp and the second sectional ramp are deployed either manually or by the motor driven mechanism.

9. The ramp assembly of claim 1, wherein the first sectional ramp and the second sectional ramp each have a side barrier that automatically moves to an upright position when the first sectional ramp and the second sectional ramp are deployed and retract to a flat position when the first sectional ramp and second sectional ramp are stored.

10. The ramp assembly of claim 7, further comprising a sensor for providing a signal indicating the presence of a person or obstacle in the path of the first and second sectional ramps as it extends, said sensor being interconnected with the motor mechanism for controlling movement of the first and second sectional ramps.

11. The ramp assembly of claim 1, wherein the ramp assembly has a low-profile.

12. A ramp assembly, comprising:

an elongated frame sized and shaped to extend between a first door on a first side of a vehicle and a second door on a second side of the vehicle and aligned opposite the first door;

a sectional ramp disposed on the frame and comprising at least a first end section and a second end section; and a floorplate structure covering the sectional ramp such that the ramp is deployed between the frame and the floorplate structure, wherein the sectional ramp is slidably movable along the frame from a stored position to a first deployed position where at least a portion of the first end section extends from the first door of the vehicle at adjustable lengths and angles and a second deployed position where at least a portion of the second end section extends from the second door of the vehicle at adjustable lengths and angles.

13. A method of retrofitting a railcar with a ramp, the railcar comprising a body with a first side, a second side opposed to the first side, a floor, at least a first door positioned on the first side and a second door positioned on the second side and aligned opposite the first door and seats positioned on the floor of the railcar, the method comprising the steps of:

providing a ramp assembly comprising:

an elongated frame sized and shaped to extend between the first door and the second door;

a sectional ramp disposed on the frame and comprising at least a first end section and a second end section; and a floorplate structure covering the sectional ramp such that the ramp is deployed between the frame and the floorplate structure;

positioning the elongated frame of the ramp assembly on the floor of the railcar between the first door and the second door aligned opposite each other on opposed sides of the railcar such that the ramp is extendable from the first door or the second door;

coupling the elongated frame of the ramp assembly to the floor of the railcar; and coupling a motor driven mechanism positioned on one of a wall surface, ceiling, and floor pocket of the railcar to the ramp assembly for slidably moving the first and second sectional ramps on the frame.

14. The ramp assembly of claim 12, wherein the ramp assembly is positioned such that it does not cover an opening formed by the first door and the second door of the railcar and does not alter a floor to ceiling height at a threshold of the first door or the second door.

15. The ramp assembly of claim 12, further comprising a motor driven mechanism for slidably moving the sectional ramp on the frame.

16. The ramp assembly of claim 15, wherein the sectional ramp is deployed either manually or by the motor driven mechanism.

17. The ramp assembly of claim 12, wherein the sectional ramp has a pair of side barriers that automatically move to an upright position when the sectional ramp is deployed and retract to a flat position when the sectional ramp is stored.

18. The ramp assembly of claim 12, wherein the ramp assembly has a low-profile.

19. The ramp assembly of claim 12, wherein the ramp assembly has a width that is about the same as the width of a first door and the width of a second door.

20. The ramp assembly of claim 15, further comprising a sensor for providing a signal indicating the presence of a person or obstacle in the path of the ramp as it extends, said sensor being interconnected with the motor mechanism for controlling movement of the ramp.

* * * * *

UNITED STATES PATENT AND TRADEMARK OFFICE

CERTIFICATE OF CORRECTION

PATENT NO. : 7,802,337 B2
APPLICATION NO. : 11/928481
DATED : September 28, 2010
INVENTOR(S) : van Roosmalen et al.

It is certified that error appears in the above-identified patent and that said Letters Patent is hereby corrected as shown below:

Face of the Patent, See Item (56) References Cited, U.S. PATENT DOCUMENTS, page 2, Column 2, insert the following:

-- 2002/0081184 A1* 06/2002 Sternberg --

Signed and Sealed this
First Day of March, 2011

David J. Kappos

David J. Kappos
*Director of the United States Patent and Trademark Office*